US009091975B2

(12) United States Patent
Hara

(10) Patent No.: US 9,091,975 B2
(45) Date of Patent: Jul. 28, 2015

(54) FIXING DEVICE

(71) Applicant: CANON KABUSHIKI KAISHA, Tokyo (JP)

(72) Inventor: Nobuaki Hara, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/011,180

(22) Filed: Aug. 27, 2013

(65) Prior Publication Data

US 2014/0064754 A1 Mar. 6, 2014

(30) Foreign Application Priority Data

Sep. 4, 2012 (JP) ..... 2012-194003

(51) Int. Cl.
*G03G 15/20* (2006.01)

(52) U.S. Cl.
CPC ..... *G03G 15/2039* (2013.01); *G03G 15/2025* (2013.01); *G03G 15/2042* (2013.01)

(58) Field of Classification Search
CPC ..... G03G 15/2046; G03G 15/2089
USPC ..... 399/68
See application file for complete search history.

(56) References Cited

U.S. PATENT DOCUMENTS

| | | | | |
|---|---|---|---|---|
| 5,991,565 | A * | 11/1999 | Hanyu et al. | 399/69 |
| 6,047,158 | A * | 4/2000 | Morigami et al. | 399/328 |
| 6,115,563 | A * | 9/2000 | Miyamoto | 399/67 |
| 6,650,863 | B2 * | 11/2003 | Fuma | 399/329 |
| 7,299,001 | B2 * | 11/2007 | Yamazaki | 399/327 |
| 7,466,934 | B2 * | 12/2008 | Chae et al. | 399/69 |
| 7,907,882 | B2 | 3/2011 | Hara | |
| 8,050,612 | B2 * | 11/2011 | Kinouchi et al. | 399/333 |
| 8,107,871 | B2 * | 1/2012 | Finn et al. | 399/334 |
| 8,229,338 | B2 * | 7/2012 | Nanataki et al. | 399/327 |
| 8,290,387 | B2 | 10/2012 | Hara | |
| 8,554,097 | B2 | 10/2013 | Hara et al. | |
| 2005/0089343 | A1 * | 4/2005 | Mathers | 399/69 |
| 2007/0071475 | A1 * | 3/2007 | Blair et al. | 399/68 |
| 2011/0236083 | A1 * | 9/2011 | Shimizu et al. | 399/327 |
| 2012/0027480 | A1 | 2/2012 | Hara | |
| 2013/0034363 | A1 | 2/2013 | Hara | |
| 2013/0058673 | A1 * | 3/2013 | Kikkawa | 399/69 |
| 2014/0112678 | A1 * | 4/2014 | Hara | 399/70 |

FOREIGN PATENT DOCUMENTS

| | | | |
|---|---|---|---|
| JP | 4-174482 | A | 6/1992 |
| JP | 2011-53597 | A | 3/2011 |
| JP | 2013054114 | A * | 3/2013 |

* cited by examiner

*Primary Examiner* — Clayton E Laballe
*Assistant Examiner* — Leon W Rhodes, Jr.
(74) *Attorney, Agent, or Firm* — Fitzpatrick, Cella, Harper & Scinto

(57) ABSTRACT

A fixing device includes first and second rollers forming a nip for fixing a toner image on a sheet; a heat absorption roller for absorbing heat from said first roller by contacting said first roller; a moving mechanism for moving said heat absorption roller to and away from said first roller; a counter for counting a number of continuously executed fixing process operations without said heat absorption roller contacting said first roller; a controller for determining, based on an output of said counter, whether to carry out an operation of a mode in which said heat absorption roller is contacted to said first roller by said moving mechanism and is rotated for a predetermined period, during non-fixing process period.

15 Claims, 10 Drawing Sheets

FIXING DEVICE

FIELD OF THE INVENTION AND RELATED ART

The present invention relates to a fixing device for fixing a toner image on a sheet.

An image forming apparatus such as a copying machine is provided with a fixing device. In the fixing device, a recording paper (sheet the) carrying an unfixed toner image (developer image) is nipped and fed by a pair of rotatable members, during which the toner is melted and fixed into a permanent image on the recording paper.

In such a fixing device, in other to reduce a so-called start-up period which is the period required for the device to reach a operative state from the rest state, reduction of the thermal capacity is considered.

However, the reduction of the thermal capacity results in a problem of a temperature rise in a non-sheet-passage-part. That is, when the fixing operation is performed on the small size sheet having a width which is smaller than an usable maximum width, the temperature of the non-sheet-passing area rises, with the result of extremely large temperature difference from the sheet passing area.

Japanese Laid-open Patent Application Hei 4-174482 (U.S. Pat. No. 5,212,528) discloses a device in which a heat-relieving roller (heat absorption rotatable member, heat transfer rotatable member) of hollow-cylindrical aluminum is contacted to the pressing roller, so that the heat is removed from the pressing roller along the heat-relieving roller, by which the surface temperature distribution of pressing roller and the heating roller in longitudinal direction is uniformized.

In the device in which the heat-relieving roller is contacted to the pressing roller, in order to reduce the start-up time of the fixing device, it is preferable that at the beginning of a job for continuously forming images on recording sheets, the heat-relieving roller it is spaced from the pressing roller. With the progress of the job, the heat-relieving roller is brought into contact to the pressing roller at the time when the non-sheet-passage-part reaches an ineligible temperature.

The inventor has found that such a heat-relieving roller can be used as a cleaning roller.

In such a case, however, another problem arises, that is, if the job is finished without the temperature of the non-sheet-passage-part reaching the ineligible temperature, the heat-relieving roller never contacts to the pressing roller, and therefore, the is kept out of contact to the pressing roller for a long term, if such jobs are repeatedly executed thereafter.

As a result, the cleaning function of the heat-relieving roller is not executed for a long term, and the pressing roller (heating roller) would be kept contaminated.

SUMMARY OF THE INVENTION

Accordingly, it is an object of the present invention to provide a fixing device in which the cleaning function of the heat absorption rotatable member can be properly executed.

It is another object of the present invention to provide a fixing device in which the cleaning function of the heat transfer rotatable member can be properly executed.

According to an aspect of the present invention, there is provided a fixing device comprising first and second rotatable members forming a nip in which a toner image on a sheet is heat fixed; a heat absorption rotatable member configured and positioned to absorb heat from said first rotatable member by contacting said first rotatable member; a moving mechanism configured to move said heat absorption rotatable member to and away from said first rotatable member; a counter configured to count a number of continuously executed fixing process operations without said heat absorption rotatable member contacting said first rotatable member. a controller configured to determine, on the basis of an output of said counter, whether to carry out an operation of a mode in which said heat absorption rotatable member is contacted to said first rotatable member by said moving mechanism and is rotated for a predetermined period, during non-fixing process period.

These and other objects, features, and advantages of the present invention will become more apparent upon consideration of the following DESCRIPTION OF THE EMBODIMENTS of the present invention, taken in conjunction with the accompanying drawings

DESCRIPTION OF THE EMBODIMENTS

The preferred embodiments of the present invention will be described in conjunction with the accompanying drawings. Here, the dimensions, the sizes, the materials, the configurations, the relative positional relationships of the elements in the following embodiments and examples are not restrictive to the present invention unless otherwise stated.

Embodiment 1

(1) An Example of Image Forming Apparatus

Figure 1:
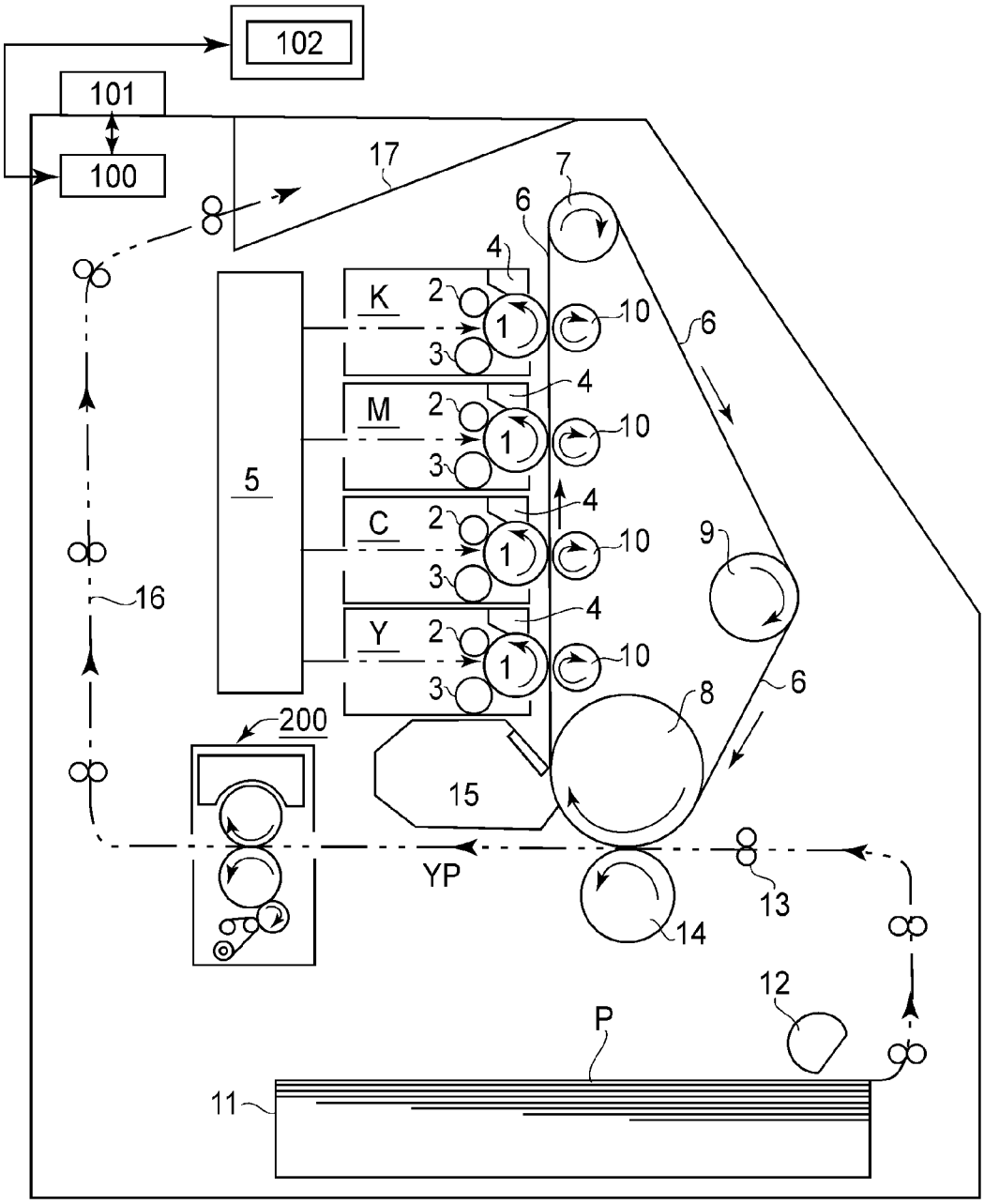
FIG. 1 is a schematic view of an example of an image forming apparatus according to Embodiment 1 of the present invention.

FIG. 1 is a schematic view of an example of an image forming apparatus comprising an image heating apparatus 200 according to an embodiment of the present invention as a fixing device. The image forming apparatus is a color image forming apparatus (printer the) of an electrophotographic type. The image forming apparatus forms a color image corresponding to electrical image information inputted to a control circuit portion 100 from an external host apparatus 102 such as a personal computer on a recording paper (sheet recording material) P, which is outputted as a print (hard copy). Designated by a reference numeral 101 is an operating portion, by which various image forming conditions and/or used recording sheet can be inputted to a control circuit portion 100. The operating portion includes a display portion for displaying various information.

Designated by Y, C, M, K are image forming stations for forming yellow, cyan, magenta and black chromatic toner images, respectively, and are arranged in the order named from the bottom. Each of the image forming stations Y, C, M, K includes a photosensitive drum 1, a charging device 2, a developing device 3, a cleaning device 4 and so on.

The developing device 3 of the image forming station Y accommodates yellow (Y) toner, and the developing device 3 of the image forming station C accommodates cyan (C) toner. The developing device 3 of the image forming station M accommodates magenta (M) toner, and the developing device 3 of the image forming station K accommodates black (K) toner.

An optical system 5 for forming electrostatic latent images by exposure of the drums 1 is provided for the image forming stations Y, C, M, K. The optical system is a laser scanning exposure optical system. In each of the image forming stations Y, C, M, K, the drum 1 is charged uniformly by the charging device 2 are is exposed and scanned by the image data by the optical system 5 so that an electrostatic latent image is formed on the surface of the drum correspondingly to the exposure image pattern.

These electrostatic latent images are developed into chromatic toner images by the developing devices 3, respectively. More particularly, the Y chromatic toner image is formed on the drum 1 of the image forming station Y; the C chromatic toner image is formed on the drum 1 of the image forming station C; a M chromatic toner image is formed on the drum 1 of image forming station M; and the K chromatic toner image is formed on the drum 1 of the image forming station K.

The chromatic toner images formed on the drums 1 of the image forming stations Y, C, M, K are primary-transferred superposingly onto the intermediary transfer member 6 which is rotated substantially at the same speed in synchronism with the rotation of the drums 1. By this, a full-color toner image (unfixed) is formed on the intermediary transfer member 6. In this embodiment, an endless intermediary transfer belt is used as the intermediary transfer member 6, and is stretched around a driving roller 7, a secondary transfer roller, an opposing roller 8 and a tension roller 9, and is driven by the driving roller 7.

The primary transferring means for the transfer of the toner image from the drum 1 of the image forming stations Y, C, M, K onto the belt 6 is a primary transfer roller 10. A primary transfer bias of a polarity opposite to that of the toner is applied to the roller 10 from a bias voltage source (unshown). By this, the toner images are primary-transferred from the drums 1 of the image forming stations Y, C, M, K onto the belt 6. The toner (residual toner) remaining on the drums 1 after the primary transfer from the drums 1 of the image forming stations Y, C, M, K onto the belt 6 are removed by a cleaning device 4.

These steps are carried out in synchronism with the rotation of the belt 6, so that the primary transferred toner images are superposed on the belt 6. In the case of a monochromatic image formation (monochromatic mode), the above-described steps are carried out only for the intended color.

On the other hand, the recording paper P in the recording paper cassette 11 is fed out one by one by feeding roller 12, and is fed at predetermined timing by registration rollers 13 to the secondary transfer nip where the belt 6 is pressed against a secondary transfer roller 14 backed up by the roller 8. The primary transfer composition toner image formed on the belt 6 is transferred (secondary transfer) all together onto the recording paper P by a bias voltage of a polarity opposite to that of the toner applied from the bias voltage source (unshown) to the roller 14. Secondary-untransferred toner remaining on the belt 6 after the secondary transfer is removed by a middle transfer belt cleaning device 15. Designated by an arrow YP is a feeding direction of the recording paper.

The toner image secondary-transferred onto the recording paper P is melted, color-mixed and fixed on the recording paper by the fixing device 200 which is the image heating apparatus, and the recording paper P is delivered to a sheet discharge tray 17 through a sheet discharge path 16 as a full color print.

(2) Fixing Device 200

Figure 2:
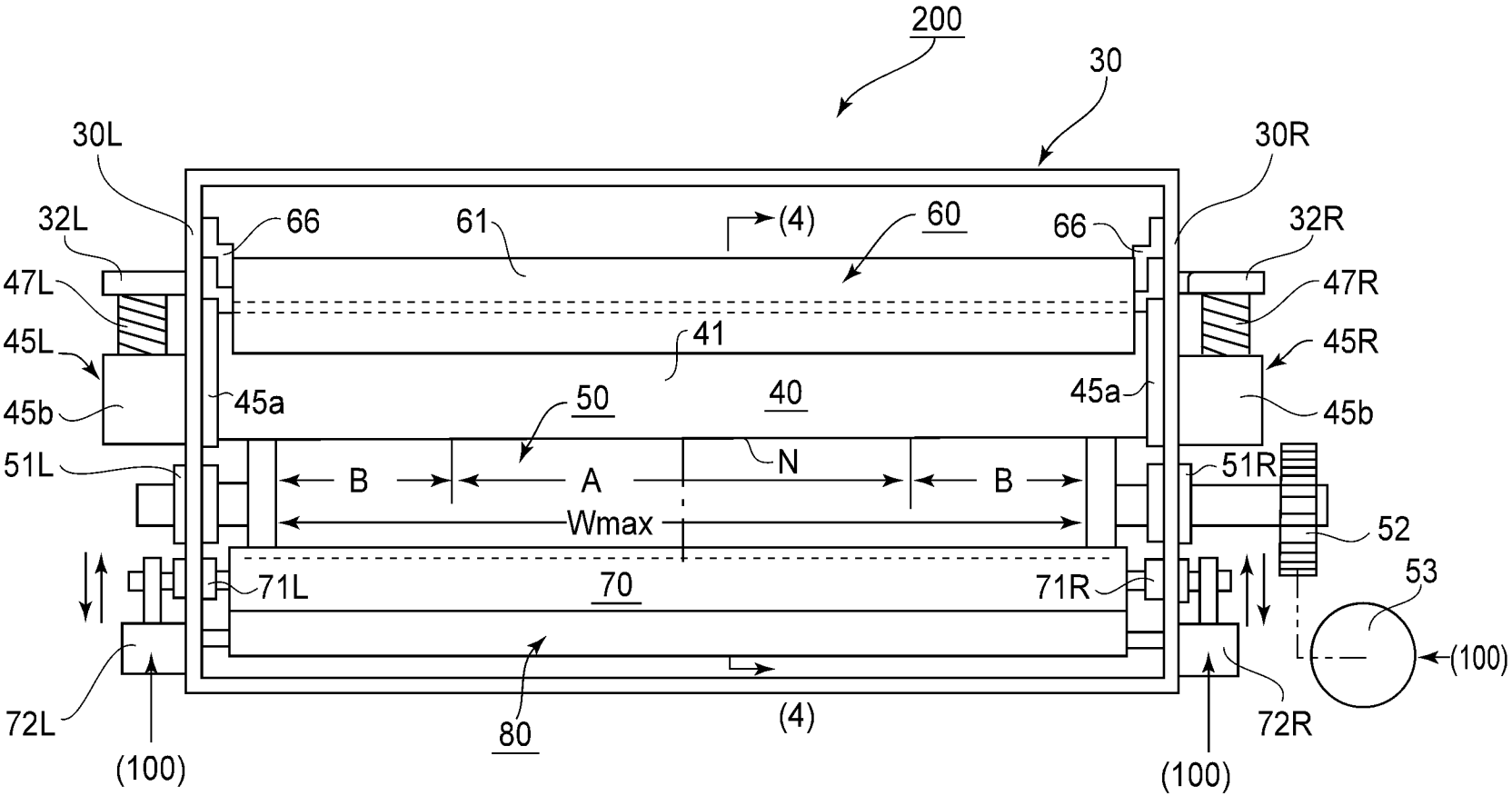
FIG. 2 is a substantial front view of major parts of fixing device.
Figure 3:
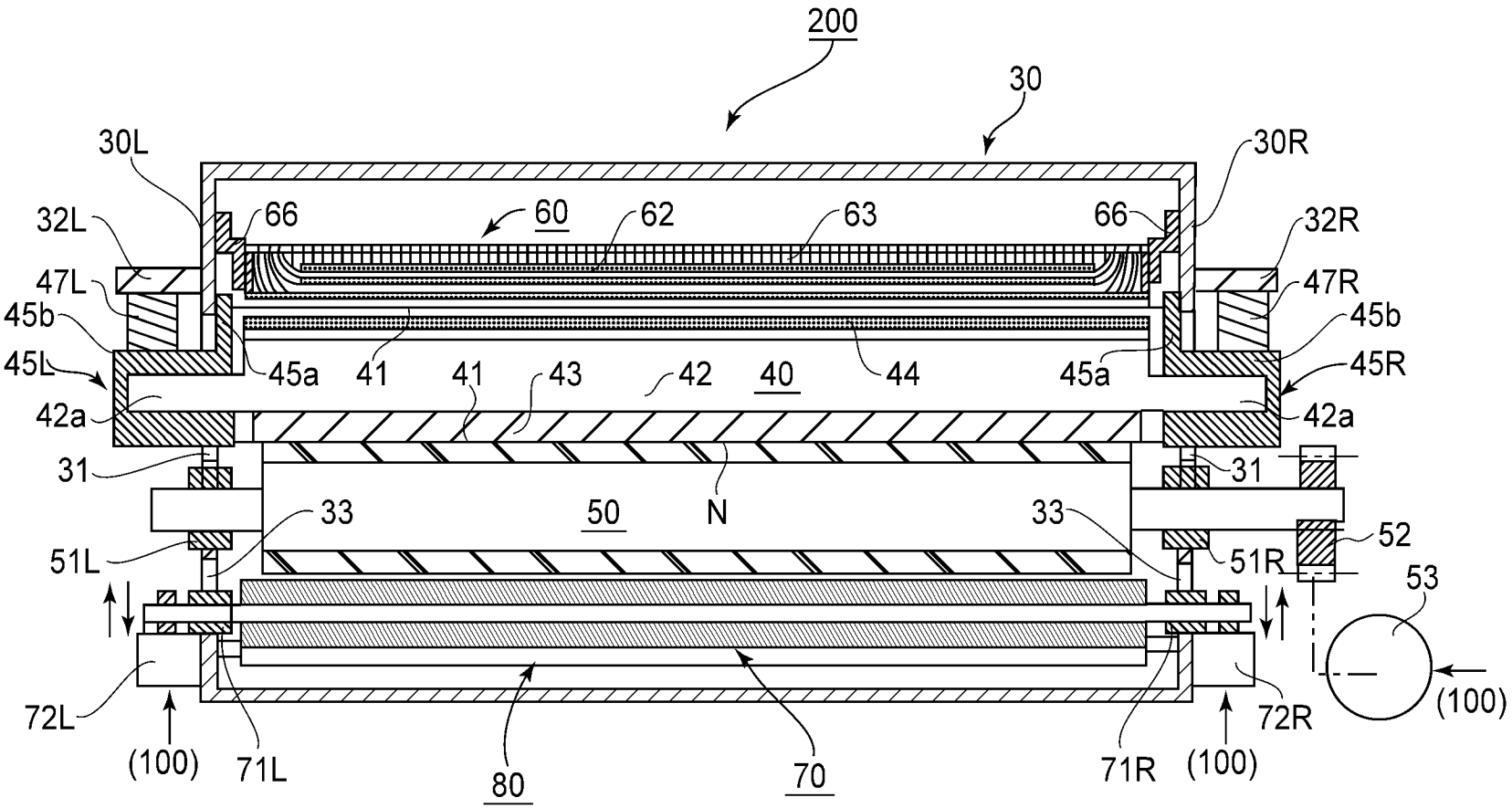
FIG. 3 is a longitudinal section view of fixing device.
Figure 4:
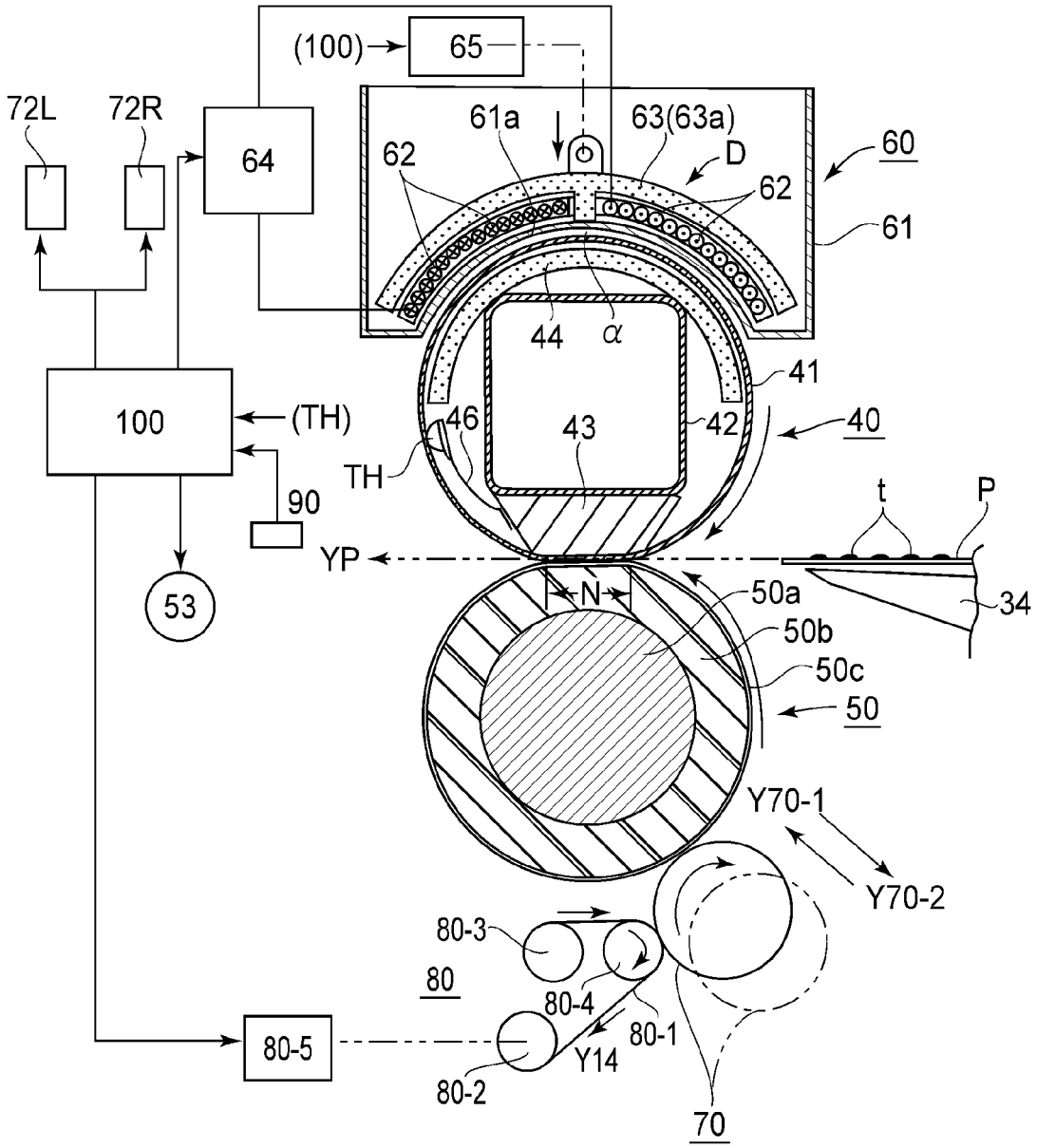
FIG. 4 is an enlarged right-hand side view taken along a line (4)-(4) of FIG. 2.

FIG. 2 is a substantial front view of the major parts of the fixing device 200; FIG. 3 is a longitudinal section of the major parts of the same device 200; and FIG. 4 is an enlarged right-hand side view taken along a line (4)-(4) of FIG. 2. In the following description, a longitudinal direction of the fixing device 200 or a member constituting it is an axial direction (thrust direction) of rotatable member, that is, a direction perpendicular to the recording paper feeding direction YP within a recording paper feeding path plane or a direction parallel with the perpendicular direction. In addition, a widthwise direction is a direction parallel with the recording paper feeding direction YP.

With respect to the fixing device 200, a front side is the entrance of the recording paper, a rear surface is the side opposite thereto (recording paper exit), and left and right are those as seen from the front side. The up side and down side are those with respect to the direction of gravity. Upstream and downstream are based on the recording paper feeding direction. A recording paper size or a sheet feeding width of recording paper are a dimension of the recording paper (width) measured in the direction perpendicular to the recording paper feeding direction YP in the recording paper surface.

The fixing device 200 is provided with a magnetic field generating means outside a heating member (image heating apparatus of external heating type and electromagnetic induction heating type). The device 200 includes a device chassis 30, left and right side plates 30L, 30R, a heating assembly 40, elastic pressing roller 50, a coil unit 60 as the magnetic field generating means, a temperature uniforming roller 70 and cleaning device 80 which are provided between the left and right side plates 30L, 30R.

(2-1) Heating Assembly 40:

The heating assembly 40 includes a rotatable member (heating member, rotatable heating member, fixing member) 41 having a magnetic member (metal layer, electroconductive member) for generating electromagnetic induction heat when passing through the region in which a magnetic field generated by coil unit 60 exists, which will be described hereinafter. In this embodiment, the rotatable member 41 is a flexible fixing belt (endless belt) 41 having a cylindrical shape. It further comprises a metal stay 42 inserted into the belt 41. To a bottom surface of stay 42, a pressing pad 43 as a pressure applying member extending along the length of the stay is mounted.

A pad 43 is made of heat resistive resin material and forms a fixing nip N by applying an urging force between the belt 41 and the pressing roller 50. The stay 42 is made of steel in this embodiment because it requires a rigid to apply a pressure to the nip N. Above the stay 42, a magnetic blocking core as a magnetic blocking member (inside magnetic core) 44 extends over the length of the stay to prevent induction heating and temperature rise of the stay 42 by the magnetic field generated by the coil unit 60.

Left and right opposite end portions of stay 42 are each provided with an extension arm portion 42*a* which is projected outwardly of the end portion of the belt 41. To the left and right extension arm portions 42*a*, flange members 45L, 45R are fitted symmetrically. The belt 41 is loosely fitted around the stay 42, the pad 43 and the core 44, and is limited by the flange portions 45*a* of the left and right flange members 45L, 45R in the movement in the longitudinal direction (left-right direction).

A temperature sensor TH such as a thermister as a temperature detecting means (temperature detecting element) for detecting a temperature of belt 41 is supported through an elastic supporting member 46 at the longitudinally central portion of pad 43. The sensor TH is elastically contacted to the inner surface of belt 41 by a member 46. By this, even if a sensor contact surface of belt 41 waves, the sensor TH can follow the position change of the belt 41 to keep the proper contact state.

{0032} said heating assembly 40 is engaged between left and right side plates 30L, 30R with longitudinal guide slit portions 31 of the side plates 30L, 30R having pressure receiving portions 45*b* of left and right flange members 45L, 45R. Therefore, the heating assembly 40 is movable in the up and down direction along the longitudinal guide slit portion 31 between the left and right side plates 30L, 30R.

Figure 6:
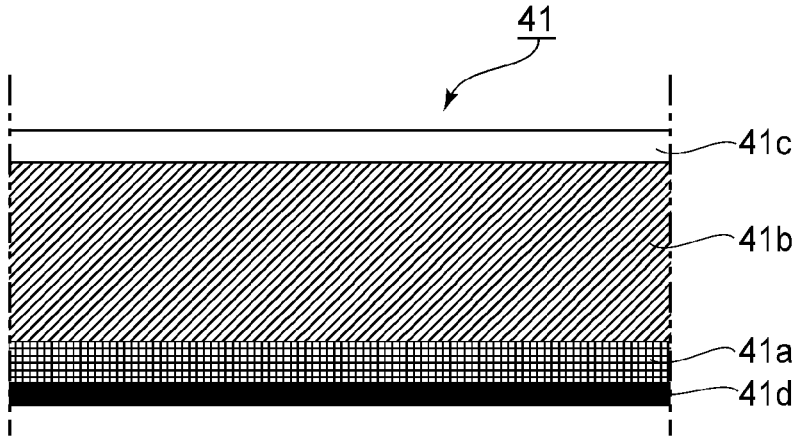
FIG. 6 is a schematic view illustrating a layer structure of fixing belt.

FIG. 6 is a schematic view illustrating a layer structure of belt 41. In this embodiment, the belt 41 has an inner diameter of 30 mm and includes a nickel base layer (magnetic member, metal layer) 41*a* manufactured by electro-casting. Base layer 41*a* has a thickness of 40 μm. On the outer periphery of base layer 41*a*, a heat resistive silicone rubber layer is provided as an elastic layer. A preferable range of the thickness of silicone rubber layer is 100-1000 μm.

In this embodiment, the thickness of the silicone rubber layer 41*b* is 300 μm so that a thermal capacity of belt 41 is small to reduce the warming-up time and to properly fix the color images. The silicone rubber has a hardness of 20 degrees (JIS-A20) and a thermal conductivity of 0.8 W/mK. On the outer periphery of elastic layer 41*b*, a fluorinated resin material layer (PFA or PTFE, for example) of 30 μm thickness as a surface parting layer 41*c*.

Inner side of base layer 41*a* may be provided with a fluorinated resin material or polyimide material layer (sliding layer) 1*d* of 10-50 μm thickness to decrease sliding friction relative to a temperature sensor TH1 as the temperature detecting means. In this embodiment, the layer 1*d* of polyimide resin having a thickness of 20 μm is provided.

The belt 41 as a whole has a low thermal capacity and has a flexibility (elasticity), and is cylindrical in a free state. The material of the metal layer 41*a* of belt 41 may be a ferro-alloy, copper, silver or the like metal. The metal may be laminated on a base resin layer. A thickness of metal layer 41*a* may be adjusted in accordance with a magnetic permeability and an electrical conductivity of metal layer 41*a* and a frequency of a high frequency current through the excitation coil (magnetic field generation coil) 62 which will be described hereinafter, within the range of 5-200 μm approximately.

(2-2) Pressing Roller 50:

The pressing roller 50 is a rotatable member (pressing member, driving rotatable member). The pressing roller 50 is rotatably supported by bearings 51L, 51R fixed on the left and right side plate 30L, 30R below the heating assembly 40, and the axial direction of the pressing roller 50 is substantially in parallel with the longitudinal direction of assembly 40.

In this embodiment, the pressing roller 50 includes a core metal 50*a* of ferro-alloy having a diameter of 20 mm in the longitudinally central portion and having a diameter of 19 mm at the opposite end portions, and includes a silicone rubber layer into elastic layer 50*b* to provide an outer diameter of 30 mm of the elastic pressing roller 50 On the surface thereof, a fluorinated resin material layer (PFA or PTFE, for example) of 30 μm thickness is provided as a parting layer 50*c*. The pressing roller 50 has a hardness of ASK-C70 degrees in the longitudinally central portion. The taper configuration of the core metal 50*a* is intended to assure uniform pressure in the fixing nip N over the longitudinal direction between the belt 41 and the pressing roller 50 even if the pad 43 deforms when the pressing roller 50 is urged.

The right side end portion of core metal 50*a* is provided with a drive gear 52 fixed thereto. To the gear 52, a driving force of fixing motor 53 controlled by the control circuit portion 100 is transmitted through transmitting means (unshown) so that the pressing roller 50 is rotated in the counterclockwise direction Y50 indicated by an arrow in the counterclockwise direction Y50 in FIG. 4 at a predetermined speed.

(2-3) Pressing Portion:

The outsides of the left and right side plates 30L, 30R is provided with spring receiving seats 32L, 32R fixed thereto. Urging springs (elastic members) 47L, 47R are provided compressed between the lower surface of spring receiving seats 32L, 32R and an upper surface of the pressure receiving portions 45*b* of the flange members 45L, 45R, respectively.

The stay 42 is pressed down together with the left and right flange members 45L, 45R by the force of the compressed urging springs 47L, 47R so that the pad 43 is press-contacted to the pressing roller 50 against the elasticity of the elastic layer 50*b* through the belt 41. By this, a fixing nip N of a predetermined width (feeding direction YP of the recording paper) is formed between the belt 41 and the pressing roller 50. The pad 43 assists the formation of a pressure profile in the nip N.

The width of the nip N in this embodiment is approx. 9 mm at the opposite longitudinal end portions and approx. 8.5 mm in the central portion, when the nip pressure is 600 N. Under this condition, the feeding speeds of the recording paper P at the opposite end portions are higher than that at the central portion, and therefore, the paper crease does not tend to occur.

Thus, by the belt 41 which is a first rotatable member and the pressing roller 50 which is a second rotatable member, the nip N for nipping, feeding and heating the recording paper carrying the t.

(2-4) Coil Unit 60:

The coil unit 60 is a heating mechanism for induction-heating the belt 41 is provided at a fixed position relative to the left and right side plates 30L, 30R in the upper side of the assembly 40, that is, at the side diametrically opposite the pressing roller 50 side. The unit 60 is provided with a housing 61 extends along the belt 41, an excitation coil 62, a magnetic core 63 or the like which are mounted to the housing 61.

The housing 61 is elongated in the left-right direction and is a horizontal box type heat resistive resin material molded part (mold member of electrically insulative resin material). A bottom plate 61*a* of housing 61 is opposed to the belt 41. The bottom plate 61*a* is curved inwardly of the housing 61 along a substantially half circumference of the outer peripheral surface of belt 41 in the cross-section. The housing 61 is open at the side opposite the bottom plate 61*a* side as an opening. The bottom plate 61*a* side of the housing 61 is faced to the upper surface of belt 41 with a predetermined gap (gap)

a therebetween, and the left and right end portions thereof are fixed to the left and right side plates 30L, 30R by brackets 66.

Figure 7:
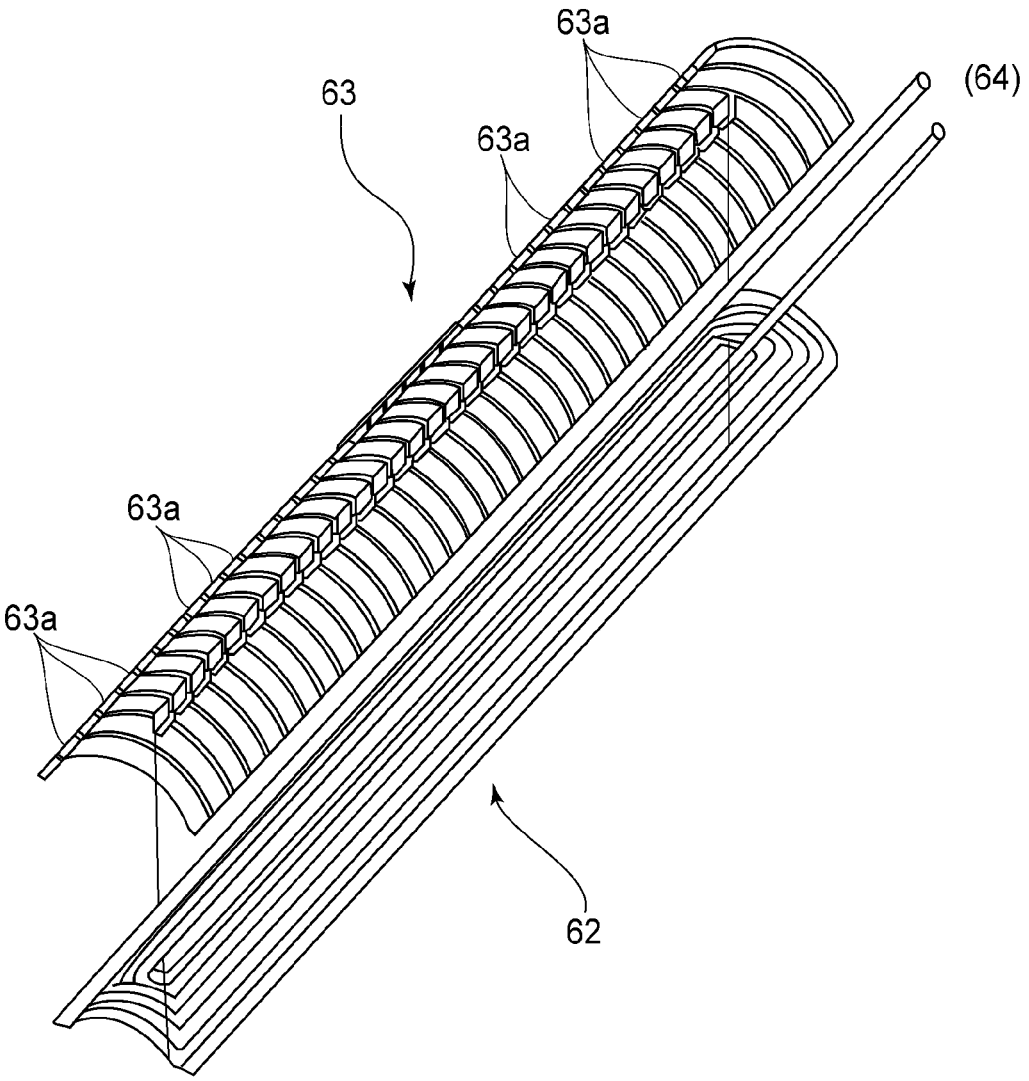
FIG. 7 is an exploded perspective view of the coil and the core of coil unit.

The coil 62 is make Litz wire, which is wound into an elongated ship bottom configuration as shown in FIG. 7, and is faced to a peripheral surface and a part of side surface of belt 41. It is accommodated in the housing in contact with the inward curved inner surface of housing bottom plate 61*a*. The coil 62 is supplied with a high frequency current of 20-50 kHz from a voltage source device (excitation circuit) 64 controlled by the control circuit portion 100.

A core 63 is an external magnetic core covering the coil 62 so as to prevent the magnetic field generated by the coil 62 from leaking to other than the metal layer (electroconductive layer) of the belt 41. The core 63 extends along the longitudinal direction the belt 41, and is divided into a plurality of pieces in the direction perpendicular to the recording paper feeding direction, and surrounds a winding central portion of coil 62 and the circumference.

Figure 5:
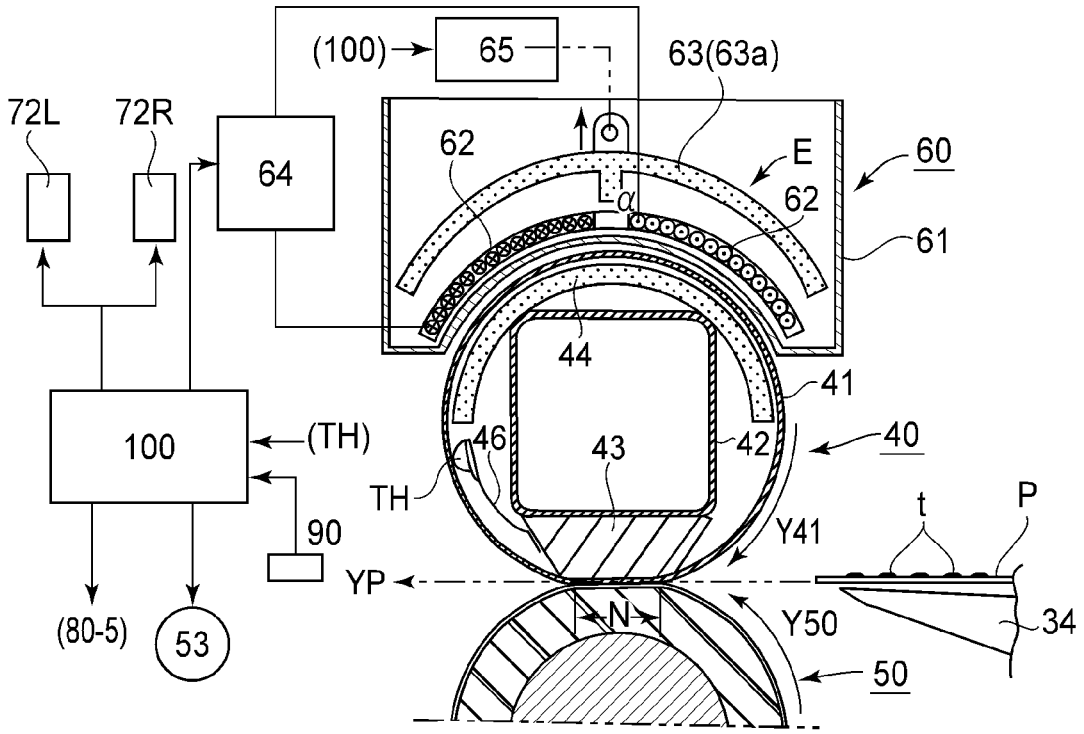
FIG. 5 is a view in which a divided movable core of a coil unit is in a second distance position.

Thus, the core 63 extends along the longitudinal direction of the belt 41. As shown in FIG. 7, it is divided into the pieces arranged in the longitudinal direction, and the pieces are individually movable in the direction toward and away from the belt 41 (divided movable core pieces 63*a*). There is provided an core moving means (core moving mechanism) for moving the cores 63*a* below a first distance position D (FIG. 4) in which the core pieces 63*a* are close to the belt 41 and a second distance position E (FIG. 5) remoter from the belt 41 than in the position D.

Specific structures of the core moving means 65 are omitted for simplicity, but may have the structures disclosed in Japanese Laid-open Patent Application 2011-53597, for example.

(2-5) Temperature Uniforming Roller 70:

The temperature uniforming roller 70 is a rotatable member (heat absorption rotatable member, heat movement rotatable member). In this embodiment, the temperature uniforming roller 70 is capable of moving toward and away from the pressing roller 50. The temperature uniforming roller 70 contacts the pressing roller 50 and functions to uniformize the temperature (heat distribution, temperature distribution) in the longitudinal direction (rotational axis direction) of pressing roller 50, by which the temperature rise in the non-sheet-passage-part is eased. The temperature uniforming roller 70 may be contacted to the belt 41 not to the pressing roller 50, so that the temperature distribution of belt 41 in the longitudinal direction is uniformized. In this case, the following description with respect to the temperature uniforming roller 70 applies by replacing the pressing roller 50 with the belt 41.

The temperature uniforming roller 70 is a high thermoconductivity metal roller made of aluminum or copper (solid core metal), and has a length corresponding to the length of pressing roller 50. The metal roller is provided with a surface layer which is a toner parting layer (fluorine coating) of 20 μm thickness so as to prevent deposition of foreign matter thereto.

In this embodiment, the temperature uniforming roller 70 extends in parallel with the pressing roller 50 below the pressing roller 50 between the left and right side plates 30L, 30R, and is rotatably supported through shafts 71L, 71R. The shafts 71L, 71R are engaged with guide slit portions 33 which are formed in the left and right side plates 30L, 30R, extending in an inclined direction. Therefore, the temperature uniforming roller 70 is movable along the guide slit portions 33 (FIG. 3) in the oblique upward direction indicated by an arrow Y70-1 in FIG. 4 and in the oblique downward direction indicated by an arrow Y70-2.

To the outsides of side plates 30L, 30R, electromagnetic solenoids 72L, 72R are fixed, respectively. A left side shaft end of temperature uniforming roller 70 is rotatably supported by a plunger of the left side electromagnetic solenoid 72L. In addition, a right side shaft end of temperature uniforming roller 70 is rotatably supported by a plunger of right side electromagnetic solenoid 72R. The left and right electromagnetic solenoids 72L, 72R are ON/OFF controlled by the control circuit portion 100.

When the left and right electromagnetic solenoid 72L, 72R are energized, the plunger protrudes to move the temperature uniforming roller 70 in the oblique upward direction of the arrow Y70-1. By this, the temperature uniforming roller 70 is pressed against the pressing roller 50 over the total length at a predetermined urging force (contact state, indicated by solid lines in FIG. 4). The temperature uniforming roller 70 contacted to the pressing roller 50 is driven by the pressing roller 50 rotated in the direction of an arrow Y70.

When the left and right electromagnetic solenoids 72L, 72R are deenergized, the plunger retracts to move the temperature uniforming roller 70 in the oblique downward direction of an arrow Y70-2. By this, the temperature uniforming roller 70 is moved to a non-contact state spaced from the pressing roller 50 by a predetermined distance (indicated by chain lines in FIGS. 4).

(2-6) Cleaning Device 80:

The cleaning device 80 functions to remove the toner and/or paper dust deposited onto the surface of the temperature uniforming roller 70 from the pressing roller 50. In this embodiment, the cleaning device 80 is a web cleaning device which is disposed between the left and right side plates 30L, 30R below the pressing roller 50.

Figure 8:
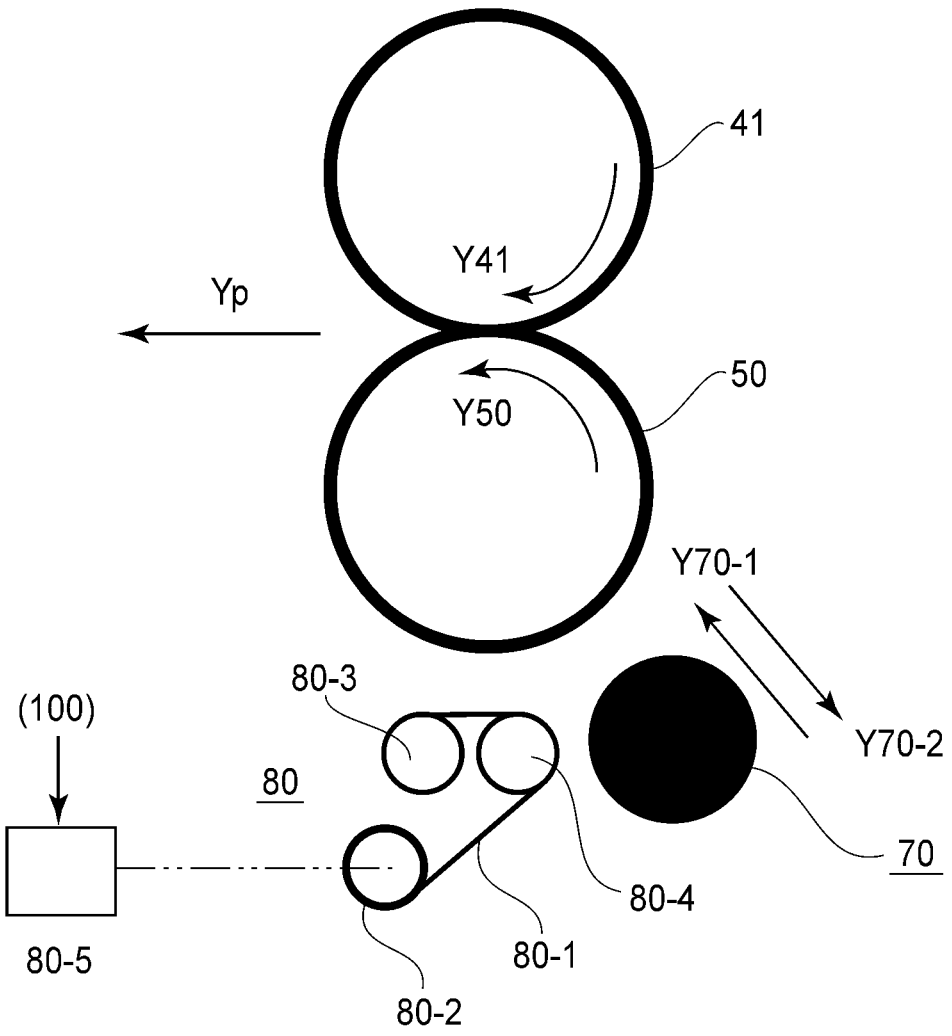
FIG. 8 is a schematic view in which the temperature uniforming roller is spaced from the pressing roller.
Figure 9:
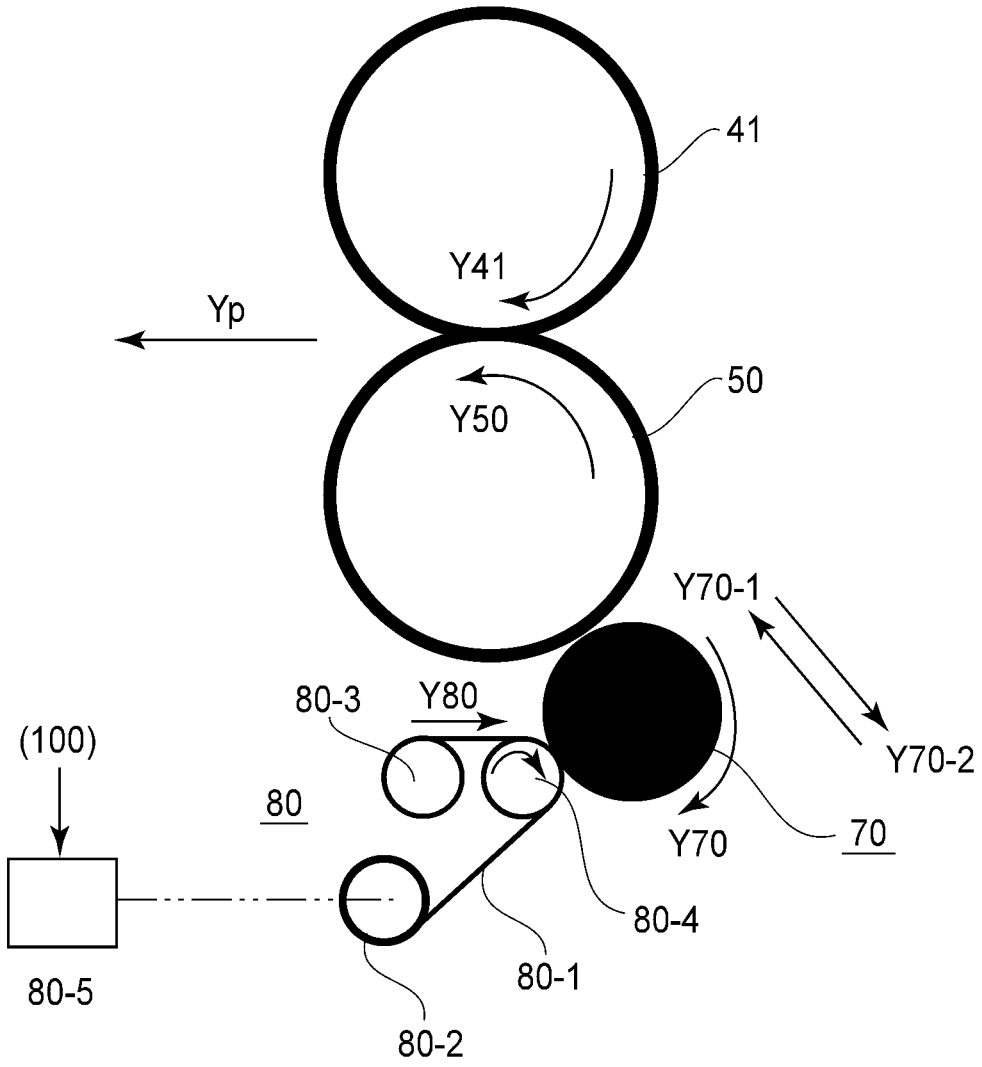
FIG. 9 is a schematic view in which the temperature uniforming roller is urged to the pressing roller.

FIG. 8 and FIG. 9 are schematic views only of the belt 41, the pressing roller 50, the temperature uniforming roller 70 and the cleaning device 80. FIG. 8 illustrates the non-contact state in which the temperature uniforming roller 70 is spaced from the pressing roller 50, and FIG. 9 illustrates the contact state in which the temperature uniforming roller 70 is urged to the pressing roller 50. The cleaning device 80 is disposed at such a position that it is spaced from the temperature uniforming roller 70 together with a spacing operation of the temperature uniforming roller 70 from the pressing roller 50.

In order to feed the recording paper P in the direction of the arrow YP, the belt 41 rotates in the direction of an arrow Y41, and the pressing roller 50 rotates in the direction of an arrow Y50. When the temperature rise of non-sheet-passage-part of belt 41 becomes high, the temperature uniforming roller 70 moves in the direction of an arrow 70-1 to be grown into contact to the pressing roller 50 and the cleaning device 80 (from FIG. 8 to FIG. 9). The temperature uniforming roller 70 it driving in the direction of the arrow Y70 by the frictional force relative to the pressing roller 50.

The cleaning device 80 comprises a cleaning sheet (cleaning web) 80-1, two aluminum pipes 80-2 and 80-3, a cleaning roller 80-4 of sponge, and a cleaning sheet winding-up mechanism 80-5. The cleaning sheet 80-1 may be a non-woven fabric of methane aramid fibers. Specific mechanism structures of cleaning sheet winding-up mechanism 80-5 are omitted in the Figure, but it may be properly constructed using a motor, a ratchet and so on.

The cleaning sheet 80-1 is wound on the aluminum pipe (supply shaft) 80-3, and is locked on the aluminum pipe (winding-up shaft) 80-2 via the cleaning roller 80-4. The cleaning sheet winding-up mechanism 80-5 is controlled by the control circuit portion 100, and the aluminum pipe 80-2 is rotated in the sheet winding-up direction. By the rotation of the aluminum pipe 80-2, the cleaning sheet 80-1 is gradually fed in the direction of an arrow Y14 via the cleaning roller 80-4 and is wound up on the aluminum pipe 80-2.

In the contact state in which the temperature uniforming roller 70 is contacted to the pressing roller 50, the temperature uniforming roller 70 is contacted also to the cleaning roller 80-4 of cleaning device 80 against the elasticity of sponge. By this, the cleaning sheet 80-1 stretched around the cleaning roller 80-4 is press-contacted to the temperature uniforming roller 70. The width of cleaning sheet 80-1 covers the total length of temperature uniforming roller 70. Therefore, the surface of the rotating temperature uniforming roller 70 is wiped and cleaned by the cleaning sheet 80-1 press-contacted thereto.

When the temperature uniforming roller 70 is contacted to the pressing roller 50 and the cleaning device 80, the control circuit portion 100 controls the cleaning sheet winding-up mechanism 80-5 so that the cleaning sheet 80-1 is pulled by a predetermined distance each time the recording paper P passes the fixing device 200. In this embodiment, the cleaning sheet 80-1 is fed by 0.02 mm each time two A4 sheets are passed through the fixing device 200.

When the temperature uniforming roller 70 is spaced from the pressing roller 50, the temperature uniforming roller 70 is also spaced from the cleaning roller 80-4. And, sheet winding-up operation of cleaning sheet 80-1 of the cleaning device 80 stops.

(2-7) Fixing Operation:

In a stand-by state of the image forming apparatus, the fixing motor 53 of the fixing device 200 is OFF so that the pressing roller 50 stops. The electric energy supply to the coil 62 of unit 60 is OFF. The electric power supply to the electromagnetic solenoids 72L, 72R are also OFF, and the temperature uniforming roller 70 is space from the pressing roller 50 and from the cleaning device 80.

The control circuit portion (controller) 100 renders a motor 530N at predetermined control timing on the basis of an input of an image formation start signal. By this, the pressing roller 50 is rotated at the predetermined speed in the counterclockwise direction of the arrow Y50 in FIG. 4.

By the rotation of pressing roller 50, the belt 41 is rotated by the frictional force between the surface of the pressing roller 50 and the surface of the belt 41 in the nip N. The belt 41 is rotated around the stay 42, the pad 43 and the core 44 in the clockwise direction of the arrow Y41 at the same speed as the rotational speed of pressing roller 50, while the inner surface of the belt 41 is in sliding contact with the lower surface of the pad 43. The movement in the thrust during the rotation of belt 41 is limited by the flange portions 45*a* of the left and right flange members 45L, 45R.

Belt 41 is rotated by the pressing roller 50 rotated by the motor 53 controlled by the control circuit portion 100, at least during the image formation execution. The rotation is such that the peripheral speed is substantially the same as the feeding speed of recording paper P carrying the unfixed toner image t from the secondary transfer nip. In the case of this embodiment, the rotational speed of the surface of the belt 41 is 321 mm/sec, with which 80 A4 prints of full-color images can be fixed, or 58 A4R prints can be fixed per 1 minute.

The control circuit portion 100 supplies an alternating current (high frequency current) of 20 kHz-500 kHz, for example, to the coil 62 from the voltage source device 64. The coil 62 generates an alternating magnetic flux (magnetic field) by the supply of alternating current. The alternating magnetic flux is directed by the core 63 to the metal layer 41*a* of the belt 41 in the top side of belt 41 which is rotating. Then, eddy currents are produced in the metal layer 41*a*, and the joule heat is generated by the eddy currents within the metal layer 41*a* (electromagnetic induction heat generation) so that the temperature of the belt 41 rises.

Thus, the rotating belt 41 is heated by the electromagnetic induction heat generation of the metal layer 41*a* when passing the region of the magnetic field generated by the coil unit 60, so that all circumference is heated. In this embodiment, the belt 41 and the coil 62 of the unit 60 are electrically insulated from each other by the housing bottom plate (mold) 61*a* having a thickness of 0.5 mm. The gap between the belt 41 with coil 62 is constantly 1.5 mm (the distance (gap $\alpha$) between the surface of the housing bottom plate 61*a* and the surface of the belt is 1.0 mm), and therefore, the belt 41 is uniformly heated.

The temperature of the belt 41 is detected by the temperature sensor TH. The temperature sensor TH detects temperature of the portion corresponding to the sheet passing area of belt 41, and the detected temperature information is fed-back to control circuit portion 100. The control circuit portion (temperature control means) 100 controls the electric power supply to the coil 62 from the voltage source device 64 so that the detected temperature received from the temperature sensor TH (information of the detected temperature) is maintained at the predetermined target temperature (fixing temperature, the information corresponding to the predetermined temperature).

More particularly, when the detected temperature of belt 41 reaches a predetermined temperature, the electric power supply to the coil 62 is shut off. In this embodiment, the frequency of high frequency current is changed to control the electric power supplied to the coil 62 on the basis of the detected value of temperature sensor TH so that the target temperature of belt 41 is maintained at 180 degree C.

In the state that the pressing roller 50 is driven, and the temperature of the belt 41 is maintained at the predetermined fixing temperature, the recording paper P carrying the unfixed toner image t is introduced into the nip N while being guided by the guiding member 34 with the toner image carrying surface facing toward the belt 41 side. The recording paper P is close-contacted to the outer peripheral surface of belt 41 in the nip N and is nipped and fed together with the belt 41.

By this, the heat is supplied mainly from the belt 41, and the pressure is applied in the nip N, by which the unfixed toner image t is fixed by heat and pressure on the surface of the recording paper P. The recording paper P having passed through the nip N is separated by the curvature of the outlet portion of the nip N and is fed to the outside of the fixing device.

The coil unit 60 is disposed outside, not inside, of the belt 41 having a high temperature, and therefore, the temperature of the coil 62 does not tend to rise, and the electric resistance does not increase, by which the loss of the joule heat generation can be reduced even if the high frequency current is supplied. In addition, the external disposition of the coil 62 is effective to permit reduction of the diameter of the belt 41 (low thermal capacity), which is effective for the energy saving property.

The warming-up time of fixing device 200 of this embodiment as short as approx. 15 sec and until the target temperature 180 degree C. is reached, when 1200 W is supplied to the coil 62, because the thermal capacity is low. In addition, the heating operation during the stand-by period is unnecessary, so that the electric power consumption amount can be reduced.

(2-8) Suppression of Temperature Rise in Non-Sheet-Passage-Part:

In FIG. 2, Wmax is a maximum width of the large size sheet capable of passing in device 16 (sheet passing area). In this embodiment, the large size sheet is 13 inch×19 inch paper (longitudinal feeding).

Region A is a sheet passing area of a small size sheet having a width smaller than Wma. In the device of this embodiment, the widthwise position of the sheet P is determined by center alignment feeding. Designated by O is the center alignment position. A region B is a non-sheet-passing area in the belt 41 and the pressing roller 50 occurring when the small size sheet is passed. It is a difference region ((Wmax−A)/2) between the sheet passing area Wmax of the large size sheet and the sheet passing area A of the small size sheet, and it appears on both sides of the sheet passing area A.

When such small size sheets are continuously sheet processed, the non-sheet-passing area B of belt 41 generates heat with the predetermined amount of heat generation per unit length similarly to the sheet passing area A, despite the fact that the generated heat is not consumed to heat the recording paper P. Therefore, the temperature of the portion of the belt 41 corresponding to the non-sheet-passing area B becomes higher than in the sheet passing area A (so-called non-sheet-passage-part temperature rise phenomenon). By this, the temperature of the pressing roller 50 in contact with the belt 41 also rises in the non-sheet-passage-part beyond the sheet passage region temperature.

If a thickness of the heating member is reduced in an attempt to reduce the thermal capacity in order for a high speed temperature rise of the heating member, a cross-sectional area in the cross-section perpendicular to the axis is also reduced, and therefore, the heat conduction in the axial direction becomes not enough. This tendency is increases with decrease of the thickness, and is further remarkable in the case of the material such as resin material having a low thermal conductivity. This will be understood from the Fourier's law that the heat quantity Q transferred between two points per unit time is $Q=\lambda \cdot f(\theta 1-\theta 2)/L$ where $\lambda$ is thermal conductivity; $\theta 1-\theta 2$ is a temperature difference between the two points, L is a distance therebetween.

This does not cause a problem in the case of the recording paper having the maximum sheet processing width. However, in the case of the continuous sheet processing of small size sheets, the non-sheet-passage-part is significant.

The non-sheet-passage-part temperature rise may result in reduction of the heat resistive lifetime of peripheral members made of resin material and/or thermal damage thereof. Moreover, in the case that immediately after continuous sheet processing of the small size sheets, a larger width recording paper is processed, paper creases and/or fixing non-uniformity attributable to the local unevenness of the temperature.

Such a temperature difference between the sheet passing area and the non-sheet-passing area increases with increase of the throughput (print number per unit time) and with increase of the thermal capacity of the recording paper. Therefore, the heating apparatus comprising a thin and low thermal capacity heating member is difficult in the use with a copying machine having a high throughput.

According to this embodiment, the non-sheet-passage-part temperature rise in the case of the small size sheet processing is properly suppressed by a combination of a selective motion control for the divided movable core pieces 63*a* of unit 60, and a contact and spacing control of the temperature uniforming roller 70 for the pressing roller 50. This will be described.

a) Suppression of Non-Sheet-Passage-Part Temperature Rise by Motion Control of Divided Movable Core Pieces 63*a*:

As described hereinbefore, the core 63 of unit 60 extends along the longitudinal direction the belt 41, and as shown in FIG. 7, the core 63 Is divided into divided movable core pieces 63*a* which are independently movable toward and away from the belt 41. There is provided a core moving mechanism 65 is controlled by control circuit portion 100 to move the divided movable core pieces 63*a*.

When the recording paper is a small size sheet, the control circuit portion 100 positions the divided movable core pieces 63*a* corresponding to the sheet passing area A of a small size sheet at a first distance position D. The other divided movable core pieces are positioned at a second distance position E by the core moving mechanism 65.

In this embodiment, in the first distance position D, the core pieces 63*a* are close to the coil 41 with a gap of a 0.5 mm as shown in FIG. 4, and in the second distance position E they are away from the coil 41 by a gap of 10 mm. When the core piece 63*a* is in the first distance position D, a heat generating efficiency is significantly high in the portion of the belt 41 corresponding to the core piece. On the other hand, when the core piece 63*a* is in the second distance position E, the heat generating efficiency is low.

Since the outer magnetic core 63 is divided into the plural pieces 63*a* in the direction perpendicular to the recording paper feeding direction so as to avoid the non-sheet-passage-part temperature rise in the case of various sheet sizes such as post card, A5, B4, A4, A3 and/or expanded A3. In the non-sheet-passing area, the external magnetic core moves away from the excitation coil 6 to weaken the magnetic flux density through the fixing belt 41. In this embodiment, an inner diameter of the excitation coil 62 in the longitudinal direction is 352 mm, and the outer diameter is 392 mm. The divided movable core piece 63*a* of external magnetic core 63 has a width of 10 mm measured in the longitudinal direction, and the divided movable core pieces 63*a* are disposed at an interval of 1.0 mm.

When a print job starts, {0088} control circuit portion 100 reads an input value of the size of recording paper. When the recording paper is a large size sheet, all of the divided movable core pieces 63*a* are positioned in the first distance position D. When it is a small size sheet, the divided movable core pieces corresponding to the sheet passing area A of small size sheet are positioned at the first distance position D, and the other divided movable core pieces are positioned at the second distance position E.

By doing so, the heat generating efficiency in the portion corresponding to the non-sheet-passing area B of belt 41 because lower than that in the portion corresponding to the sheet passage region A, so that the temperature rise of the belt 41 and the pressing roller 50 in the non-sheet-passage-part is suppressed.

b) Suppression of Non-Sheet-Passage-Part Temperature Rise by Contacting and Spacing of the Temperature Uniforming Roller 70:

In this embodiment, when not less than 30 sheets are processed, the temperature uniforming roller 70 is contacted to the pressing roller 50.

Then, the temperature uniforming roller 70 contacts to the pressing roller 50 to assist the heat conduction of the surfaces of the belt 41 and the pressing roller 50 so as to uniform the surface temperatures of the belt 41 and the pressing roller 50. Thus, the temperature uniforming roller 70 suppresses the temperature distribution non-uniformity of the belt 41 and the pressing roller 50 in the axial direction. The cleaning device 80 is provided to remove the toner and/or paper dust from the surface of the temperature uniforming roller 70.

When more than a predetermined number of the sheets P are fed into the fixing nip N, the control circuit portion 200, the temperature uniforming roller 70 is contacted to the pressing roller 50 so that the temperature uniforming roller 70 can be cleaned by the cleaning device 80.

In such a system in which the cleaning sheet 80-1 is contacted to the temperature uniforming roller 70 and the temperature uniforming roller 70, the case that image formation jobs including less than 30 sheets continue will be considered. As a comparison example, the job for 10 sheets continues for 20000 sheets, the belt 41 and the pressing roller 50 may be contaminated with the coloring material contained in the paper depending on the kind of paper, with the result of transfer of the contamination onto the image.

However, in this embodiment, the temperature uniforming roller 70 is not contacted to the pressing roller 50 by the job for less than 30 sheets, and therefore, the temperature uniforming roller 50 is not contacted to the pressing roller 50 even if 20000 sheets are processed. Therefore, the contamination on the belt 41 and the pressing roller 50 is not removed. Such a contamination may occur at the edge portion which is edge of the sheet passing area. In such a case, it cannot be expected that the contamination is removed by the paper per se.

Under the circumstances, in this embodiment, when the 10 sheet job continues for 100 sheets in total, the temperature uniforming roller 70 is contacted to the pressing roller to remove the contamination such as the coloring material by the cleaning sheet 80-1 contacted to the temperature uniforming roller 70, after the job. In this embodiment, of cleaning sheet 80-1 is fed by 0.1 mm (for 10 sheets). In this case, after each 10 sets of 10 sheet jobs (after each 100 sheets), the cleaning sheet 80-1 is fed by 0.1 mm, by which it has been confirmed that no image contamination occurs even when 20000 sheets are processed in total, no image contamination occurs.

Figure 10:
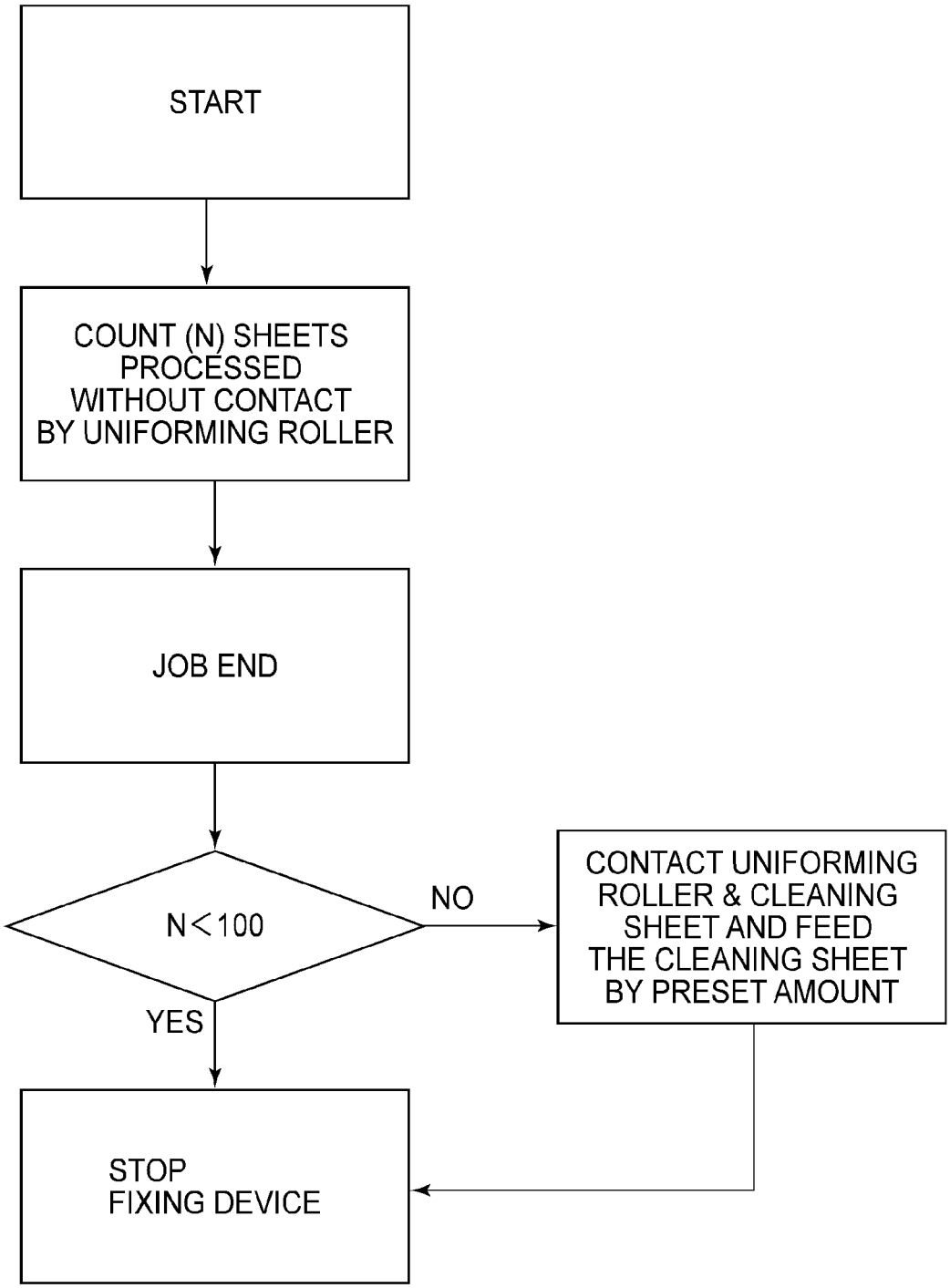
FIG. 10 is a flow chart of control.
Figure 11:
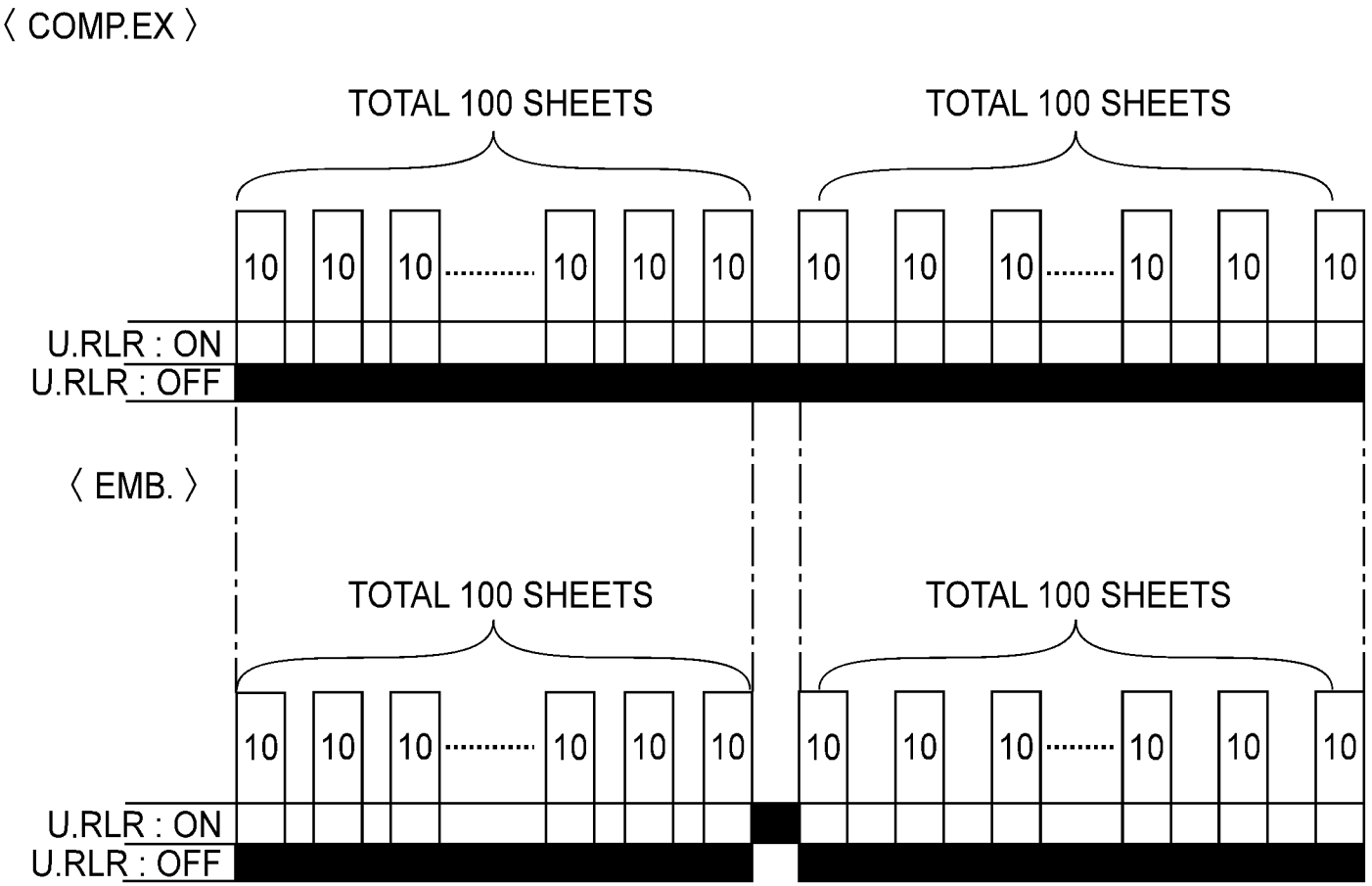
FIG. 11 illustrates demounting of temperature uniforming roller in the embodiment, and demounting of a temperature uniforming roller according to a comparison example.

FIG. 10 is a flow chart of the control. The control circuit portion (counter) 100 counts the number of sheets processed without contact of the temperature uniforming roller 70 to the pressing roller 50, and when the count reaches a predetermined number, the temperature uniforming roller 70 is contacted with the pressing roller 50 for a predetermined duration while the belt 41 and the pressing roller 50 are rotated. By this, deposition of the foreign matter to the belt 41 and the pressing roller 50 can be suppressed. FIG. 11 shows the contacting and spacing of the temperature uniforming roller 70 in this embodiment, and the contacting and spacing of the temperature uniforming roller in the comparison example.

In the foregoing description, the temperature uniforming roller 70 is not contacted in the case of the job less than 30 sheets. However, it would be considered that the temperature uniforming roller 70 is contacted even after the less than 30 sheets job, if the interval between the jobs is shorter than a predetermined time in view of the temperature rise of the non-sheet-passage-part. In such a case, the temperature uniforming roller 70 is contacted during the job, and the cleaning device 80 is contacted to the temperature uniforming roller 70. Therefore, the cleaning sheet 80-1 is fed during the job, and it is not necessary that the cleaning sheet 80-1 is fed after the job.

The control operation is summarized in the following. When only the jobs for less than a predetermined first value (30 sheets in this example) are intermittently carried out, the control circuit portion 100 integrates the counts of the jobs. When the integrated value reaches or exceeds a second value (100 in this example), the temperature uniforming roller 70 is contacted to the pressing roller 50 for a predetermined duration, in the non-fixing process (later completion of the fixing process). Then, the control mode operation in which the pressing roller 50 (belt 41) is rotated is executed. At this time, the temperature uniforming roller 70 is rotated by the pressing roller 50, and the cleaning process for the pressing roller 50 (belt 41) is carried out. By the contact of the temperature uniforming roller 70 to the pressing roller 50, the cleaning device 80 is contacted to the temperature uniforming roller 70. In addition, the control circuit portion 100 feeds the cleaning sheet 80-1 of the cleaning means 80 by a predetermined distance, in the control mode.

As described in the foregoing, the temperature uniforming roller 70 is utilized as a cleaning roller in addition to the temperature uniforming function in the control mode, by which the image disturbance attributable to the contamination of the belt 41 and the pressing roller 50 even if the sheets are processed without contact of the temperature uniforming roller 70.

Embodiment 2

In this Embodiment 2, the image forming apparatus is generally the same as that of Embodiment 1. In this embodiment, the image forming apparatus is provided with an ambient condition sensor 90 (FIGS. 2 and 3) for detecting temperature/humidity of the ambient condition under which the device is placed. The temperature/humidity information of the ambient condition detected by the ambient condition sensor 90 is inputted to the control circuit portion 200. In the control mode, the control circuit portion 200 changes the feeding amount of cleaning sheet 80-1 of cleaning means 80 depending on the temperature/humidity detected by the ambient condition sensor 90. This will be described in detail.

The amount of paper dust produced from the recording paper is different depending on the ambient condition under which the image shape device is placed. The ambient condition is such that the absolute water content is large, the amount of the paper dust produced by the sheet is small, and when the absolute water content is small, the amount of the paper dust is large. By decreasing the feeding amount of the cleaning sheet 80-1, the image forming apparatus can be operated for a longer time period without exchanging the cleaning sheet.

According to this embodiment, the sheet feeding amount of the cleaning sheet 80-1 of the cleaning device 80 under an ambient condition 2 (room temperature of 30 degree C. and humidity of 80%) in which the absolute water content is large is smaller than under an ambient condition 1 (room temperature of 23 degree C. and humidity of 5%) in which the water content is small, in the control of the control circuit portion 100. By this, the image forming apparatus can be operated for a longer period without exchanging the cleaning sheet 80-1.

The case will be considered in which the 10 sheet job continues for 20000 sheets in total. In this Embodiment 2, under the ambient condition 1, after each 100 processings of A4 sheets, the temperature uniforming roller is contacted to the pressing roller after the job to feed the cleaning sheet by 0.1 mm.

However, under the ambient condition 2, after each 1000 processings of A4 sheets, the temperature uniforming roller is contacted to the pressing roller after the job to feed the cleaning sheet by 0.1 mm.

It has been confirmed that no image defect occurs in either of the ambient conditions with such feeding of the cleaning sheet 80-1.

Embodiment 3

In this Embodiment 3, the image forming apparatus is generally the same as that of Embodiment 1. In this embodiment, the control circuit portion 200 changes the feeding amount of the cleaning sheet 80-1 of cleaning means 80 in the control mode depending on the kind of recording paper. This will be described.

In this embodiment, the kind of used recording paper can be inputted to a operating portion 101 of image forming apparatus or an external host apparatus 102. The control circuit portion 200 receiving the information changes the feeding amount of cleaning sheet.

As compared with the plain paper, the amount of the paper dust is smaller than in the case of coated paper. Therefore, in the case of the coated paper, the feeding amount of cleaning sheet 80-1 is decreased, by which the image forming apparatus can be operated for a long term without the exchanging the cleaning sheet.

The feeding amount of cleaning sheet 80-1 of the cleaning device 80 is smaller for the coated paper than for the plain paper, in the control circuit portion 200. By this, the image forming apparatus can be operated for a longer period without exchanging the cleaning sheet 80-1.

The case will be considered in which the 10 sheet job continues for 20000 sheets in total. In this Embodiment 3, for the plain paper, after each 100 processings of A4 sheets, the temperature uniforming roller is contacted to the pressing roller after the job to feed the cleaning sheet by 0.1 mm.

For the coated paper, after each 10000 processings of A4 sheets, the temperature uniforming roller is contacted to the pressing roller after the job to feed the cleaning sheet by 0.1 mm.

It has been confirmed that no image defect occurs in either of the kinds of paper with such feeding of the cleaning sheet 80-1.

[Others]

1) In the embodiments, the temperature uniforming roller 70 is provided so as to be movable toward and away from the pressing roller 50 which is one of the rotatable member constituting a pair for the fixing process forming the nip, but it may be movable toward and away from to belt 41 which is the other of the rotatable members.

2) The belt 41 may be a flexible endless belt member stretched and circulating around a plurality of stretching members. The belt 41 which is a rotatable member may be a roller member.

3) The pressing roller 50 is a rotatable member may be an endless belt member.

4) The rotatable members 41 and 50 constituting the fixing station forming the nip may be rotatable members.

5) The heating mechanism for heating the rotatable member 41 or the rotatable member 41 and the rotatable member 50 is not limited to the electromagnetic induction heating mechanism. Another heating mechanism using a halogen heater, an infrared radiation lamp, a ceramic heater or the like is usable.

6) The fixing device 200 of the present invention is usable as a glossiness applying device (fixing device) for improving a glossiness of an image by re-heating the image already fixed on the recording paper.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 194003/2012 filed Sep. 4, 2012, which is hereby incorporated by reference.

What is claimed is:

1. A fixing apparatus comprising:

first and second rotatable members configured to form a nip portion, in which a toner image on a sheet is fixed by heat and pressure, therebetween;

a heat absorbing rotatable member configured to absorb heat from said first rotatable member by contacting said first rotatable member;

a moving mechanism configured to move said heat absorbing rotatable member between a contact position where said heat absorbing rotatable member contacts said first rotatable member and a separate position where said heat absorbing rotatable member is separated from said first rotatable member;

a cleaner configured to clean said heat absorbing rotatable member in the contact position;

a counter configured to count the number of sheets, each having a width smaller than a maximum width for which said apparatus is operable, passing through the nip portion; and a controller configured to control an operation of said moving mechanism based on an output of said counter, wherein when the value counted by said counter reaches a first value during an execution of a job, said controller causes said heat absorbing rotatable member to move from the separate position to the contact position for absorbing the heat from said first rotatable member; and wherein when the value counted by said counter is larger than a second value, which is larger than the first value, during an execution of a plurality of the jobs with said heat absorbing rotatable member being kept in the separate position, said controller causes said heat absorbing rotatable member to move from the separate position to the contact position for cleaning said first rotatable member via said heat absorbing rotatable member by said cleaner.

2. An apparatus according to claim 1, wherein when the value counted by said counter is larger than the second value during the execution of the plurality of the jobs with said heat absorbing rotatable member being kept in the separate position, said controller causes said heat absorbing rotatable member to move from the separate position to the contact position after the plurality of the jobs is executed.

3. An apparatus according to claim 1, wherein said first rotatable member is disposed at a side opposed to a side at which the toner image on the sheet is contacted.

4. An apparatus according to claim 1, wherein said second rotatable member is an endless belt to be driven by said first rotatable member.

5. An apparatus according to claim 1, wherein said cleaner includes a winding-up type cleaning web, and said cleaning web is disposed so as to be spaced from said heat absorbing rotatable member with a movement of said heat absorbing rotatable member from the contact position to the separate position.

6. A fixing apparatus according to claim 4, wherein said first rotatable member is a roller.

7. An apparatus according to claim 1, wherein said heat absorbing rotatable member is effective to promote transfer of heat in said first rotatable member in a longitudinal direction thereof.

8. An apparatus according to claim 1, wherein said heat absorbing rotatable member is a roller including a metal core coated with a toner parting layer.

9. A fixing apparatus comprising:

an endless belt configured to heat a toner image on a sheet at a nip portion;

a driving roller configured to (i) rotationally drive said endless belt and (ii) form the nip portion cooperatively with said endless belt therebetween;

a heat absorbing roller configured to absorb heat from said driving roller by contacting said driving roller;

a moving mechanism configured to move said heat absorbing roller between a contact position where said heat absorbing roller contacts said driving roller and a separate position where said heat absorbing roller is separated from said driving roller;

a cleaner configured to clean said heat absorbing roller in the contact position; and a controller configured to control an operation of said moving mechanism, wherein said apparatus is operable in a first mode in which said controller causes said heat absorbing roller to move from the separate position to the contact position during a job for absorbing the heat from the endless belt via said driving roller, and a second mode in which said controller causes said heat absorbing roller to move from the separate position to the contact position after the job for cleaning said driving roller via said heat absorbing roller by said cleaner.

10. An apparatus according to claim 9, wherein said endless belt is disposed at a side opposed to a side at which the toner image on the sheet is contacted.

11. An apparatus according to claim 9, wherein said cleaner includes a winding-up type cleaning web, and said cleaning web is disposed so as to be spaced from said heat absorbing roller with a movement of said heat absorbing roller from the contact position to the separate position.

12. An apparatus according to claim 9, wherein said heat absorbing rotatable member is effective to promote transfer of heat in said driving roller in a longitudinal direction thereof.

13. An apparatus according to claim 9, wherein said heat absorbing roller includes a metal core coated with a toner parting layer.

14. A fixing apparatus comprising:

an endless belt configured to heat a toner image on a sheet, at a nip portion;

a driving roller configured to (i) rotationally drive said endless belt, and (ii) form the nip portion cooperatively with said endless belt therebetween;

a reducing roller configured to reduce the temperature difference of said endless belt in a longitudinal direction thereof by contacting said driving roller;

a moving mechanism configured to move said reducing roller between a contact position where said reducing roller contacts said driving roller and a separate position where said reducing roller is separated from said driving rotatable roller;

a cleaner configured to clean said reducing roller in the contact position; and a controller configured to control an operation of said moving mechanism, wherein said apparatus is operable in a first mode in which said controller causes said reducing roller to move from the separate position to the contact position during a job for reducing the temperature difference of said endless belt via said driving roller, and a second mode in which said controller causes said reducing roller to move from the separate position to the contact position after the job for cleaning said driving roller via said reducing roller by said cleaner.

15. A fixing apparatus comprising:

first and second rotatable members configured to form a nip portion, in which a toner image on a sheet is fixed by heat and pressure, therebetween;

a reducing rotatable member configured to reduce the temperature difference of said first rotatable member in a longitudinal direction thereof by contacting said first rotatable member;

a moving mechanism configured to move said reducing rotatable member between a contact position where said reducing rotatable member is contacted to said first rotatable member and a separate position where said reducing rotatable member is separated from said first rotatable member;

a cleaner configured to clean said reducing rotatable member in the contact position;

a counter configured to count the number of sheets, each having width smaller than a maximum width for which said apparatus is operable, passed through the nip portion; and a controller configured to control an operation of said moving mechanism based on an output of said counter, wherein when the value counted by said counter reaches a first value during an execution of a job, said controller causes said reducing rotatable member to move from the separate position to the contact position for reducing the temperature difference, and wherein when the value counted by said counter is larger than a second value, which is larger than the first value, during an execution of a plurality of the jobs with said reducing rotatable member being kept in the separate position, said controller causes said reducing rotatable member to move from the separate position to the contact position for cleaning said first rotatable member via said reducing rotatable member by said cleaner.

* * * * *